US012398436B2

(12) United States Patent
Eguchi et al.

(10) Patent No.: US 12,398,436 B2
(45) Date of Patent: Aug. 26, 2025

(54) HIGH-STRENGTH STAINLESS STEEL SEAMLESS PIPE FOR OIL COUNTRY TUBULAR GOODS AND METHOD FOR MANUFACTURING SAME

(71) Applicant: JFE Steel Corporation, Tokyo (JP)

(72) Inventors: Kenichiro Eguchi, Tokyo (JP); Masao Yuga, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 459 days.

(21) Appl. No.: 17/913,882

(22) PCT Filed: Mar. 25, 2021

(86) PCT No.: PCT/JP2021/012626
§ 371 (c)(1),
(2) Date: Sep. 23, 2022

(87) PCT Pub. No.: WO2021/200571
PCT Pub. Date: Oct. 7, 2021

(65) Prior Publication Data

US 2023/0128437 A1 Apr. 27, 2023

(30) Foreign Application Priority Data

Apr. 1, 2020 (JP) ..... 2020-065948

(51) Int. Cl.

| | |
|---|---|
| ***C21D 9/08*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/52*** | (2006.01) |

(52) U.S. Cl.
CPC ..... *C21D 9/08* (2013.01); *C21D 8/105* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/44* (2013.01); *C22C 38/46* (2013.01); *C22C 38/52* (2013.01); *C21D 2211/001* (2013.01); *C21D 2211/008* (2013.01)

(58) Field of Classification Search
CPC .... C21D 9/08; C21D 8/105; C21D 2211/001; C21D 2211/008; C22C 38/001; C22C 38/002; C22C 38/004; C22C 38/02; C22C 38/04; C22C 38/06; C22C 38/44; C22C 38/46; C22C 38/52
See application file for complete search history.

(56) References Cited

U.S. PATENT DOCUMENTS

| | | | | |
|---|---|---|---|---|
| 7,842,141 | B2 | 11/2010 | Kimura et al. | |
| 11,306,369 | B2 | 4/2022 | Kamo et al. | |
| 2004/0238079 | A1 | 12/2004 | Kimura | |
| 2015/0152531 | A1 | 6/2015 | Eguchi et al. | |
| 2015/0315684 | A1 | 11/2015 | Eguchi et al. | |
| 2017/0096722 | A1 | 4/2017 | Fujiura et al. | |
| 2018/0209009 | A1* | 7/2018 | Tomio | C22C 38/50 |
| 2019/0100821 | A1 | 4/2019 | Eguchi et al. | |
| 2019/0136337 | A1 | 5/2019 | Eguchi et al. | |
| 2019/0368001 | A1 | 12/2019 | Kamo et al. | |
| 2021/0269904 | A1 | 9/2021 | Matsuo et al. | |
| 2022/0364211 | A1 | 11/2022 | Kamo et al. | |
| 2023/0048685 | A1 | 2/2023 | Kamo et al. | |
| 2023/0090789 | A1 | 3/2023 | Sasaki et al. | |
| 2023/0128437 | A1 | 4/2023 | Eguchi et al. | |
| 2023/0137295 | A1 | 5/2023 | Kamo et al. | |

FOREIGN PATENT DOCUMENTS

| | | | |
|---|---|---|---|
| CN | 101426941 | A | 5/2009 |
| CN | 104937126 | A | 9/2015 |
| CN | 105917015 | A | 8/2016 |
| CN | 110462085 | A | 11/2019 |
| EP | 2011891 | A1 | 1/2009 |
| EP | 2 832 881 | A1 | 2/2015 |
| EP | 2947167 | A1 | 11/2015 |
| EP | 3095886 | A1 | 11/2016 |

(Continued)

OTHER PUBLICATIONS

Non Final Office Action for U.S. Appl. No. 17/599,219 mailed Mar. 12, 2024. (10 pages).
International Search Report and Written Opinion for International Application No. PCT/JP2021/012626, dated Jun. 22, 1 2021, 6 pages.
The extended European Search Report issued Aug. 28, 2024, by the European Patent Office in corresponding European Patent Application No. 21780009.3-1103. (14 pages).
Chinese Office Action with Search Report for Chinese Application No. 202180023217.2, dated Apr. 11, 2023, 13 pages.

(Continued)

*Primary Examiner* — Brian D Walck
(74) *Attorney, Agent, or Firm* — Buchanan Ingersoll & Rooney PC

(57) ABSTRACT

A high-strength stainless steel seamless pipe for oil country tubular goods has a composition that comprises, in mass %, C: 0.002 to 0.05%, Si: 0.05 to 0.50%, Mn: 0.04 to 1.80%, P: 0.030% or less, S: 0.002% or less, Cr: more than 14.0% and 17.0% or less, Ni: 4.0 to 8.0%, Mo: 1.5 to 3.0%, Al: 0.005 to 0.10%, V: 0.005 to 0.20%, Co: 0.01 to 1.0%, N: 0.002 to 0.15%, and O: 0.006% or less, and that satisfies the predetermined formulae, and in which the balance is Fe and incidental impurities, the high-strength stainless steel seamless pipe having a microstructure containing prior austenite having an average grain size of 40 μm or less, the high-strength stainless steel seamless pipe having a yield strength of 758 MPa or more.

12 Claims, No Drawings

(56) References Cited

FOREIGN PATENT DOCUMENTS

| | | | |
|---|---|---|---|
| EP | 3 333 276 | A1 | 6/2018 |
| EP | 3456852 | A1 | 3/2019 |
| EP | B604591 | A1 | 2/2020 |
| JP | 2005105357 | A | 4/2005 |
| JP | 2012136742 | A | 7/2012 |
| JP | 2017-039963 | A | 2/2017 |
| JP | 2017039998 | A | 2/2017 |
| WO | 2004001082 | A1 | 12/2003 |
| WO | 2015178022 | A1 | 11/2015 |
| WO | 2017010036 | A1 | 1/2017 |
| WO | 2017168874 | A1 | 10/2017 |
| WO | 2018131340 | A1 | 7/2018 |
| WO | 2020013197 | A1 | 1/2020 |

OTHER PUBLICATIONS

Japanese Office Action for Japanese Application No. 2021-544277, dated Jun. 15, 2022 with Concise Statement of Relevance of Office Action, 4 pages.

* cited by examiner

HIGH-STRENGTH STAINLESS STEEL SEAMLESS PIPE FOR OIL COUNTRY TUBULAR GOODS AND METHOD FOR MANUFACTURING SAME

CROSS REFERENCE TO RELATED APPLICATIONS

This is the U.S. National Phase application of PCT/JP2021/012626, filed Mar. 25, 2021 which claims priority to Japanese Patent Application No. 2020-065948, filed Apr. 1, 2020, the disclosures of these applications being incorporated herein by reference in their entireties for all purposes.

FIELD OF THE INVENTION

The present invention relates to a high-strength stainless steel seamless pipe for oil country tubular goods suited for applications such as in crude oil wells or natural gas wells and in gas wells (hereinafter, referred to simply as oil wells), and to a method for manufacturing such a high-strength stainless steel seamless pipe.

BACKGROUND OF THE INVENTION

Increasing crude oil prices and an expected shortage of petroleum resources in the near future have prompted active development of oil fields and gas fields that were unthinkable in the past, for example, such as deep oil fields, and oil fields and gas fields of a severe corrosive environment containing hydrogen sulfide and other corrosive chemicals, or a sour environment as it is also called. Such oil fields and gas fields are usually very deep, and are found in a high-temperature atmosphere of a severe corrosive environment containing $CO_2$, $Cl^-$, and $H_2S$. Steel pipes for oil country tubular goods to be used in such environments need to be made of materials having desired high strength and desirable corrosion resistance.

Oil country tubular goods used for extraction in oil fields and gas fields of an environment containing carbon dioxide gas ($CO_2$), chlorine ions ($Cl^-$), and the like often use 13Cr martensitic stainless steel pipes. The use of improved 13Cr martensitic stainless steels having reduced carbon contents and increased contents of other elements such as nickel and molybdenum is also expanding.

For example, PTL 1 to PTL 5 describe techniques developed in connection with such demands. PTL 1 discloses a stainless steel pipe for oil country tubular goods having improved corrosion resistance achieved by having a steel composition that comprises, in mass %, C: 0.05% or less, Si: 0.50% or less, Mn: 0.20 to 1.80%, P: 0.03% or less, S: 0.005% or less, Cr: 14.0 to 18.0%, Ni: 5.0 to 8.0%, Mo: 1.5 to 3.5%, Cu: 0.5 to 3.5%, Al: 0.05% or less, V: 0.20% or less, N: 0.01 to 0.15%, and O: 0.006% or less, and that satisfies predetermined formulae, and in which the balance is Fe and incidental impurities.

PTL 2 discloses a high-strength stainless steel seamless pipe for oil country tubular goods having a yield strength of 655 MPa or more achieved by having a composition that comprises, in mass %, C: 0.005 to 0.05%, Si: 0.05 to 0.50%, Mn: 0.20 to 1.80%, P: 0.030% or less, S: 0.005% or less, Cr: 12.0 to 17.0%, Ni: 4.0 to 7.0%, Mo: 0.5 to 3.0%, Al: 0.005 to 0.10%, V: 0.005 to 0.20%, Co: 0.01 to 1.0%, N: 0.005 to 0.15%, and O: 0.010% or less, and that satisfies predetermined formulae, and in which the balance is Fe and incidental impurities.

PTL 3 discloses a high-strength stainless steel pipe for oil country tubular goods having high strength and high corrosion resistance achieved by having a composition that comprises, in mass %, C: 0.05% or less, Si: 0.50% or less, Mn: 0.10 to 1.80%, P: 0.03% or less, S: 0.005% or less, Cr: 14.0 to 17.0%, Ni: 5.0 to 8.0%, Mo: 1.0 to 3.5%, Cu: 0.5 to 3.5%, Al: 0.05% or less, V: 0.20% or less, N: 0.03 to 0.15%, O: 0.006% or less, and one or two selected from Nb: 0.2% or less and Ti: 0.3% or less, and in which the balance is Fe and incidental impurities, and by having a microstructure containing precipitates with at least 3.0 mass % of MC-type carbonitrides relative to the total amount of precipitates.

PTL 4 discloses a high-strength stainless steel seamless pipe for oil country tubular goods having a composition containing Cr and Ni, and having a microstructure containing a tempered martensitic phase as a primary phase, wherein the composition satisfies Cr/Ni≤5.3, and the steel pipe has a surface layer microstructure with a phase that turns white in color upon etching with a Vilella's solution, and that has a thickness of 10 to 100 μm along a wall thickness from the outer surface of the pipe, and is dispersed with an area percentage of 50% or more at the outer surface of the pipe.

PTL 5 discloses a high-strength martensitic stainless steel seamless pipe for oil country tubular goods having a yield strength of 655 to 862 MPa, a yield ratio of 0.90 or more, and improved carbon dioxide gas corrosion resistance and improved sulfide stress corrosion cracking resistance achieved by having a composition that comprises, in mass %, C: 0.01% or less, Si: 0.5% or less, Mn: 0.1 to 2.0%, P: 0.03% or less, S: 0.005% or less, Cr: 14.0 to 15.5%, Ni: 5.5 to 7.0%, Mo: 2.0 to 3.5%, Cu: 0.3 to 3.5%, V: 0.20% or less, Al: 0.05% or less, and N: 0.06% or less, and in which the balance is Fe and incidental impurities.

PATENT LITERATURE

PTL 1: WO2004/001082
PTL 2: WO2017/168874
PTL 3: JP-A-2005-105357
PTL 4: WO2015/178022
PTL 5: JP-A-2012-136742

SUMMARY OF THE INVENTION

The development of oil fields and gas fields in increasingly severe corrosive environments has created a demand for steel pipes for oil country tubular goods having high strength, and desirable carbon dioxide gas corrosion resistance even in severe high-temperature corrosive environments of 180° C. or more containing carbon dioxide gas ($CO_2$) and chlorine ions ($Cl^-$). The development of oil fields and gas fields in increasingly severe environments has also created a demand for desirable SSC resistance (sulfide stress cracking resistance) even in low-temperature environments such as in deep sea. Typically, high reliability is required for seamless steel pipes to be used as steel pipes for oil country tubular goods in these environments. It is known that rolling of a seamless steel pipe often damages the inner and outer surfaces of a pipe during the rolling process, and a material having high hot workability is needed to prevent such damage. There is also a growing demand for higher strength as the development of deeper wells continues to expand.

The techniques described in PTL 1 to PTL 5 provide desirable carbon dioxide gas corrosion resistance. However, these are not necessarily satisfactory in terms of SSC resistance in low-temperature environments. The techniques described in PTL 1 to PTL 5 also fail to provide a high-strength steel pipe having a YS of 150 ksi (1,034 MPa) or more.

It is accordingly an object according to aspects of the present invention to provide a solution to the problems of the related art, and provide a high-strength stainless steel seamless pipe for oil country tubular goods having high strength and superior hot workability, in addition to having excellent carbon dioxide gas corrosion resistance against an extremely severe high-temperature environment of 180° C. or more containing carbon dioxide gas ($CO_2$) and chlorine ions ($Cl^-$), and excellent SSC resistance in low-temperature environments. Aspects of the present invention are also intended to provide a method for manufacturing such a stainless steel seamless pipe.

As used herein, "high strength" means having a yield strength YS of 110 ksi (758 MPa) or more, preferably 150 ksi (1,034 MPa) or more.

As used herein, "superior hot workability" means having a percentage reduction (%) of cross section of 70% or more as measured when a round rod-shaped smooth test specimen having a diameter of 10 mm at a parallel portion is heated to 1,250° C. with a Gleeble tester, and is stretched to break after being held at the heated temperature for 100 seconds, cooled to 1,000° C. at 1° C./sec, and held for 10 seconds at this temperature.

As used herein, "excellent carbon dioxide gas corrosion resistance" means that a test specimen immersed for 14 days in a test solution (a 20 mass % NaCl aqueous solution; a liquid temperature of 180° C.; an atmosphere of 10 atm $CO_2$ gas) kept in an autoclave has a corrosion rate of 0.125 mm/y or less, and that the test specimen after the corrosion test does not have pitting corrosion that is 0.2 mm or larger in diameter upon inspection of a surface with a loupe at 10 times magnification.

As used herein, "excellent SSC resistance in low-temperature environments" means that a test specimen immersed in a test solution (a 5 mass % NaCl aqueous solution; a liquid temperature of 4° C.; $H_2S$: 0.02 bar, $CO_2$: 0.98 bar) having an adjusted pH of 4.0 by addition of 0.5 mass % acetic acid and sodium acetate has no cracks even when kept in the solution for 720 hours under an applied stress 90% of the yield stress.

The test methods will be described in detail in the Examples section below.

In order to achieve the foregoing objects, the present inventors conducted intensive investigations of various that affect low-temperature SSC resistance in factors stainless steel pipes of different compositions. The studies found that SSC (sulfide stress cracking) in stainless steel is caused by hydrogen embrittlement initiated by pitting corrosion, regardless of chemical composition of the tested steel.

The present inventors also examined possible causes of pitting corrosion and cracking, and found that, in low-temperature environments, growth of pitting corrosion and crack generation can be reduced, and the SSC resistance can improve when the prior austenite has a smaller grain size. A possible explanation for this finding is that phosphorus and sulfur that segregate at prior austenite grain boundaries (1) promote selective dissolution of prior austenite grain boundary during pitting corrosion growth, and (2) promote grain boundary embrittlement upon ingress of hydrogen into steel. That is, because a smaller prior austenite grain size means a larger grain boundary area per unit volume, the concentrations of phosphorus and sulfur that segregate at prior austenite grain boundaries decrease when the prior austenite grain size is smaller. The improved SSC resistance is probably a result of this phenomenon.

The prior austenite grain boundary has large influence on SSC resistance in low-temperature environments probably because hydrogen sulfide, which promotes ingress of hydrogen into steel, has increased dissolution in the test solution in low-temperature environments, and low temperatures inhibit formation of hydrogen gas.

Aspects of the present invention were completed after further studies based on these findings and are as follows.

[1] A high-strength stainless steel seamless pipe for oil country tubular goods having a composition that includes, in mass %, C: 0.002 to 0.05%, Si: 0.05 to 0.50%, Mn: 0.04 to 1.80%, P: 0.030% or less, S: 0.002% or less, Cr: more than 14.0% and 17.0% or less, Ni: 4.0 to 8.0%, Mo: 1.5 to 3.0%, Al: 0.005 to 0.10%, V: 0.005 to 0.20%, Co: 0.01 to 1.0%, N: 0.002 to 0.15%, and O: 0.006% or less, and that satisfies the following formulae (1) and (2), and in which the balance is Fe and incidental impurities, the high-strength stainless steel seamless pipe having a microstructure containing prior austenite having an average grain size of 40 μm or less, the high-strength stainless steel seamless pipe having a yield strength of 758 MPa or more, $$Cr+0.65Ni+0.6Mo+0.55Cu-20C \geq 18.5 \quad (1)$$

$$Cr+Mo+0.3Si-43.3C-0.4Mn-Ni-0.3Cu-9N \leq 11 \quad (2),$$

wherein Cr, Ni, Mo, Cu, C, Si, Mn, and N represent the content of each element in mass %, and the content is zero for elements that are not contained.

[2] The high-strength stainless steel seamless pipe for oil country tubular goods according to [1], wherein the composition further includes, in mass %, one or two groups selected from the following group A and group B, Group A: one or two or more selected from Cu: 3.5% or less, Ti: 0.20% or less, and W: 3.0% or less, Group B: one or two or more selected from Nb: 0.20% or less, Zr: 0.20% or less, B: 0.01% or less, REM: 0.01% or less, Ca: 0.0025% or less, Sn: 0.20% or less, Sb: 0.50% or less, Ta: 0.1% or less, and Mg: 0.01% or less.

[3] The high-strength stainless steel seamless pipe for oil country tubular goods according to [1] or [2], wherein the microstructure contains a martensitic phase having an area percentage of 70% or more.

[4] A method for manufacturing a high-strength stainless steel seamless pipe for oil country tubular goods of any one of [1] to [3], the method including:

heating a steel pipe material of said composition in a heating temperature range of 1,100 to 1,350° C., and hot working the steel pipe material into a seamless steel pipe;

quenching in which the seamless steel pipe is reheated to at least an $Ac_3$ transformation point and not more than 1,050° C., and cooled to 100° C. or less at a cooling rate of air cooling or faster; and tempering in which the seamless steel pipe is heated to a tempering temperature of 500° C. or more and not more than an $Ac_1$ transformation point.

[5] The method for manufacturing a high-strength stainless steel seamless pipe for oil country tubular goods according to [4], wherein the quenching and the tempering are repeated at least twice.

Aspects of the present invention can provide a high-strength stainless steel seamless pipe for oil country tubular goods having superior hot workability and excellent carbon dioxide gas corrosion resistance, and having excellent SSC resistance in low-temperature environments, and high strength with a yield strength YS of 758 MPa or more. Aspects of the present invention can also provide a method for manufacturing such a high-strength stainless steel seamless pipe.

DETAILED DESCRIPTION OF EMBODIMENTS OF THE INVENTION

Embodiments of the present invention are described below in detail.

The following describes the composition of a high-strength stainless steel seamless pipe for oil country tubular goods according to aspects of the present invention, and the reasons for limiting the composition. In the following, "%" means percent by mass, unless otherwise specifically stated.

C: 0.002 to 0.05%

Carbon is an important element for increasing the strength of a martensitic stainless steel. In accordance with aspects of the present invention, carbon needs to be contained in an amount of 0.002% or more to provide the desired strength. A carbon content of more than 0.05% decreases strength, rather than increasing it. A carbon content of more than 0.05% also decreases SSC resistance in low-temperature environments. For this reason, the C content is 0.002 to 0.05% in accordance with aspects of the present invention. In view of carbon dioxide gas corrosion resistance, the C content is preferably 0.040% or less. The C content is more preferably 0.035% or less, even more preferably 0.03% or less. The C content is preferably 0.01% or more, more preferably 0.02% or more.

Si: 0.05 to 0.50%

Si is an element that acts as a deoxidizing agent. This effect can be obtained with a Si content of 0.05% or more. A Si content of more than 0.50% decreases hot workability and carbon dioxide gas corrosion resistance. For this reason, the Si content is 0.05 to 0.50%. The Si content is preferably 0.10% or more, more preferably 0.15% or more. The Si content is preferably 0.40% or less, more preferably 0.30% or less.

Mn: 0.04 to 1.80%

Mn is an element that improves hot workability by inhibiting formation of δ ferrite during hot working. In accordance with aspects of the present invention, Mn needs to be contained in an amount of 0.04% or more. An excessively high Mn content has adverse effects on toughness and on SSC resistance in low-temperature environments. For this reason, the Mn content is 0.04 to 1.80%. The Mn content is preferably 0.10% or more, more preferably 0.20% or more, even more preferably 0.25% or more. The Mn content is preferably 0.80% or less, more preferably 0.60% or less, even more preferably 0.40% or less.

P: 0.030% or Less

P is an element that decreases carbon dioxide gas corrosion resistance, pitting corrosion resistance, and SSC resistance. In accordance with aspects of the present invention, phosphorus is contained in preferably as small an amount as possible. However, an overly low P content leads to increased manufacturing costs. In order to be industrially implementable at relatively low costs without causing a serious decrease of characteristics, phosphorus is contained in an amount of 0.030% or less. The P content is preferably 0.020% or less.

S: 0.002% or Less

S is contained in preferably as small an amount as possible because this element causes a serious decrease of hot workability, and decreases SSC resistance in low-temperature environments by segregating at prior austenite grain boundaries. When sulfur is contained in an amount of 0.002% or less, segregation of this element at prior austenite grain boundaries can be reduced, and the SSC resistance desired in accordance with aspects of the present invention can be obtained, provided that the average grain size of prior austenite is 40 μm or less. For these reasons, the S content is 0.002% or less. The S content is preferably 0.0015% or less.

Cr: More than 14.0% and 17.0% or Less

Cr is an element that contributes to improving corrosion resistance by forming a protective coating. In order to provide corrosion resistance at a high temperature of 180° C. or more, Cr needs to be contained in an amount of more than 14.0% in accordance with aspects of the present invention. A Cr content of more than 17.0% encourages formation of retained austenite without martensite transformation. In this case, the stability of the martensitic phase decreases, and the strength desired in accordance with aspects of the present invention cannot be obtained. A Cr content of more than 17.0% also causes precipitation of δ ferrite phase during high-temperature heating processes, and hot workability seriously decreases. For these reasons, the Cr content is more than 14.0% and 17.0% or less. The Cr content is preferably 14.2% or more, more preferably 14.4% or more, even more preferably 14.6% or more. The Cr content is preferably 16.0% or less, more preferably 15.0% or less, even more preferably 14.8% or less.

Ni: 4.0 to 8.0%

Ni is an element that acts to improve corrosion resistance by strengthening the protective coating. Ni also improves hot workability by inhibiting precipitation of δ ferrite phase. Ni increases steel strength by forming a solid solution. These effects can be obtained with a Ni content of 4.0% or more. A Ni content of more than 8.0% encourages formation of retained austenite without martensite transformation. This decreases the stability of the martensitic phase, and the strength decreases. For this reason, the Ni content is 4.0 to 8.0%. The Ni content is preferably 5.0% or more, more preferably 6.0% or more, even more preferably 6.1% or more. The Ni content is preferably 7.5% or less, more preferably 7.0% or less, even more preferably 6.5% or less.

Mo: 1.5 to 3.0%

Mo is an element that increases resistance to pitting corrosion due to $Cl^-$ and low pH. In accordance with aspects of the present invention, Mo needs to be contained in an amount of 1.5% or more. A Mo content of less than 1.5% causes decrease of corrosion resistance in severe corrosive environments. A Mo content of more than 3.0% causes formation of δ ferrite, and decreases hot workability and corrosion resistance. For these reasons, the Mo content is 1.5 to 3.0%. The Mo content is preferably 1.8% or more, more preferably 1.9% or more. The Mo content is preferably 2.5% or less, more preferably 2.3% or less.

Al: 0.005 to 0.10%

Al is an element that acts as a deoxidizing agent. This effect can be obtained with an Al content of 0.005% or more. An Al content of more than 0.10% leads to excessive oxide amounts, and has adverse effects on toughness. For these reasons, the Al content is 0.005 to 0.10%. The Al content is preferably 0.010% or more, and is preferably 0.03% or less. The Al content is more preferably 0.015% or more, and is more preferably 0.025% or less.

V: 0.005 to 0.20%

V is an element that improves steel strength by precipitation hardening. This effect can be obtained with a V content of 0.005% or more. A V content of more than 0.20% decreases low-temperature toughness. For this reason, the V content is 0.005 to 0.20%. The V content is preferably 0.03% or more, and is preferably 0.08% or less. The V content is more preferably 0.04% or more, and is more preferably 0.07% or less.

Co: 0.01 to 1.0%

Co is an element that raises the Ms point and reduces the fraction of retained austenite, and improves strength and SSC resistance. This effect can be obtained with a Co content of 0.01% or more. A Co content of more than 1.0% decreases hot workability. For this reason, the Co content is 0.01 to 1.0%. The Co content is preferably 0.05% or more, more preferably 0.07% or more. The Co content is preferably 0.15% or less, more preferably 0.09% or less.

N: 0.002 to 0.15%

N is an element that improves hot workability by inexpensively inhibiting formation of 8 ferrite. This effect can be obtained with a N content of 0.002% or more. A N content of more than 0.15% leads to formation of coarse nitrides, and low-temperature SSC resistance decreases. For this reason, the N content is 0.002 to 0.15%. The N content is preferably 0.01% or more, more preferably 0.02% or more. The N content is preferably 0.10% or less, more preferably 0.08% or less.

O (Oxygen): 0.006% or Less

O (oxygen) exists as oxides in the steel, and has adverse effects on various characteristics. For this reason, oxygen should be contained in as small an amount as possible. Particularly, an O content of more than 0.006% causes a serious decrease of hot workability and low-temperature SSC resistance. For this reason, the O content is 0.006% or less. Preferably, the O content is 0.004% or less.

In accordance with aspects of the present invention, the Cr, Ni, Mo, Cu, and C contents are confined in the foregoing ranges, and these elements satisfy the following formula (1).

$$Cr+0.65Ni+0.6Mo+0.55Cu-20C \geq 18.5 \quad \text{Formula (1)}$$

In formula (1), Cr, Ni, Mo, Cu, and C represent the content of each element in mass %, and the content is zero for elements that are not contained.

When the value on the left-hand side of formula (1) (the value of Cr+0.65Ni+0.6Mo+0.55Cu−20 C) is less than 18.5, carbon dioxide gas corrosion resistance in a high-temperature corrosive environment of 180° C. or more containing $CO_2$ and $Cl^-$ decreases. For this reason, Cr, Ni, Mo, Cu, and C are contained to satisfy formula (1) in accordance with aspects of the present invention. The value on the left-hand side of formula (1) is preferably 19.0 or more. The value on the left-hand side of formula (1) does not particularly require an upper limit. In view of reducing cost increase due to excessive addition of alloys and reducing decrease of strength, the value on the left-hand side of formula (1) is preferably 20.5 or less.

In accordance with aspects of the present invention, Cr, Mo, Si, C, Mn, Ni, Cu, and N are contained to satisfy the following formula (2).

$$Cr+Mo+0.3Si-43.3C-0.4Mn-Ni-0.3Cu-9N \leq 11 \quad \text{Formula (2)}$$

In formula (2), Cr, Mo, Si, C, Mn, Ni, Cu, and N represent the content of each element in mass %, and the content is zero for elements that are not contained.

When the value on the left-hand side of formula (2) (the value of Cr+Mo+0.3Si−43.3C−0.4Mn−Ni−0.3Cu−9N) is more than 11, it is not possible to obtain hot workability high enough to form the stainless steel seamless pipe, and steel pipe manufacturability decreases. For this reason, in accordance with aspects of the present invention, Cr, Mo, Si, C, Mn, Ni, Cu, and N are contained to satisfy formula (2). The value on the left-hand side of formula (2) is preferably 10.5 or less. The value on the left-hand side of formula (2) does not particularly require a lower limit. The value on the left-hand side of formula (2) is preferably 7 or more because the effect becomes saturated below this range.

In accordance with aspects of the present invention, the balance in the composition above is iron (Fe) and incidental impurities.

The components described above represent the basic components, and a high-strength stainless steel seamless pipe for oil country tubular goods according to aspects of the present invention can have the desired characteristics by containing these basic components. In accordance with aspects of the present invention, the following optional elements may be contained as needed, in addition to the basic components.

One or Two or More Selected from Cu: 3.5% or Less, Ti: 0.20% or Less, and W: 3.0% or Less Cu: 3.5% or Less Cu, an optional element, is an element that increases corrosion resistance by strengthening the protective coating. This effect can be obtained with a Cu content of 0.5% or more. A Cu content of more than 3.5% causes precipitation of CuS at grain boundaries, and decreases hot workability. For this reason, Cu, when contained, is contained in an amount of preferably 3.5% or less. The Cu content is preferably 0.5% or more, more preferably 0.7% or more. The Cu content is more preferably 3.0% or less, even more preferably 1.5% or less, yet more preferably 1.3% or less.

Ti: 0.20% or Less

Ti, an optional element, is an element that forms TiN, and improves SSC resistance in low-temperature environments with TiN covering oxide or sulfide inclusions. This effect can be obtained with a Ti content of 0.01% or more. The effect becomes saturated with a Ti content of more than 0.20%. For this reason, Ti, when contained, is contained in an amount of preferably 0.20% or less. The Ti content is preferably 0.01% or more, more preferably 0.03% or more, even more preferably 0.05% or more. The Ti content is more preferably 0.15% or less.

W: 3.0% or Less

W, an optional element, is an element that contributes to increasing strength. This effect can be obtained with a W content of 0.05% or more. The effect becomes saturated with a W content is more than 3.0%. For this reason, W, when contained, is contained in an amount of preferably 3.0% or less. The W content is preferably 0.05% or more, more preferably 0.5% or more. The W content is more preferably 1.5% or less.

One or Two or More Selected from Nb: 0.20% or Less, Zr: 0.20% or Less, B: 0.01% or Less, REM: 0.01% or Less, Ca: 0.0025% or Less, Sn: 0.20% or Less, Sb: 0.50% or Less, Ta: 0.1% or Less, and Mg: 0.01% or Less Nb: 0.20% or Less Nb, an optional element, is an element that increases strength. This effect can be obtained with a Nb content of 0.01% or more. The effect becomes saturated with a Nb content of more than 0.20%. For this reason, Nb, when contained, is contained in an amount of preferably 0.20% or less. The Nb content is preferably 0.01% or more, more preferably 0.05% or more, even more preferably 0.07% or more. The Nb content is more preferably 0.15% or less, even more preferably 0.13% or less.

Zr: 0.20% or Less

Zr, an optional element, is an element that contributes to increasing strength. This effect can be obtained with a Zr content of 0.01% or more. The effect becomes saturated with a Zr content of more than 0.20%. For this reason, Zr, when contained, is contained in an amount of preferably 0.20% or less. The Zr content is preferably 0.01% or more.

B: 0.01% or Less

B, an optional element, is an element that contributes to increasing strength. This effect can be obtained with a B content of 0.0005% or more. Hot workability decreases with a B content of more than 0.01%. For this reason, B, when contained, is contained in an amount of preferably 0.01% or less. The B content is preferably 0.0005% or more.

REM: 0.01% or Less

A REM (rare-earth metal), an optional element, is an element that contributes to improving corrosion resistance. This effect can be obtained with a REM content of 0.0005% or more. A REM content of more than 0.01% is economically disadvantageous because the effect becomes saturated, and the effect expected from the increased content cannot be obtained with a REM content of more than 0.018. For this reason, REM, when contained, is contained in an amount of preferably 0.01% or less. The REM content is preferably 0.0005% or more.

Ca: 0.0025% or Less

Ca, an optional element, is an element that contributes to improving hot workability. This effect can be obtained with a Ca content of 0.0005% or more. A Ca content of more than 0.0025% increases the number density of coarse Ca inclusions, and fails to provide the desired SSC resistance in low-temperature environments. For this reason, Ca, when contained, is contained in an amount of preferably 0.0025% or less. The Ca content is preferably 0.0005% or more.

Sn: 0.20% or Less

Sn, an optional element, is an element that contributes to improving corrosion resistance. This effect can be obtained with a Sn content of 0.02% or more. A Sn content of more than 0.20% is economically disadvantageous because the effect becomes saturated, and the effect expected from the increased content cannot be obtained with a Sn content of more than 0.20%. For this reason, Sn, when contained, is contained in an amount of preferably 0.20% or less. The Sn content is preferably 0.02% or more.

Sb: 0.50% or Less

Sb, an optional element, is an element that contributes to improving corrosion resistance. This effect can be obtained with an Sb content of 0.02% or more. An Sb content of more than 0.50% is economically disadvantageous because the effect becomes saturated, and the effect expected from the increased content cannot be obtained with an Sb content of more than 0.50%. For this reason, Sb, when contained, is contained in an amount of preferably 0.50% or less. The Sb content is preferably 0.02% or more.

Ta: 0.1% or Less

Ta is an element that increases strength, and has the effect to improve sulfide stress cracking resistance. Ta also has the same effect produced by Nb, and some of Nb may be replaced by Ta. These effects can be obtained with a Ta content of 0.01% or more. A Ta content of more than 0.1% decreases toughness. For this reason, Ta, when contained, is contained in an amount of preferably 0.1% or less. The Ta content is preferably 0.01% or more.

Mg: 0.01% or Less

Mg, an optional element, is an element that improves corrosion resistance. This effect can be obtained with a Mg content of 0.002% or more. When Mg is contained in an amount of more than 0.018, the effect becomes saturated, and Mg cannot produce the effect expected from the increased content. For this reason, Mg, when contained, is contained in an amount of preferably 0.01% or less. The Mg content is preferably 0.002% or more.

The following describes the microstructure of a high-strength stainless steel seamless pipe for oil country tubular goods according to aspects of the present invention, and the reason for limiting the microstructure.

To provide the desired strength, a high-strength stainless steel seamless pipe for oil country tubular goods according to aspects of the present invention has a microstructure containing a martensitic phase (tempered martensitic phase) as a primary phase. The phases other than the primary phase are a retained austenite phase, or a retained austenite phase and a ferrite phase. As used herein, "primary phase" refers to a microstructure that accounts for at least 70% of the area of the whole steel pipe.

In view of providing the desired strength, it is preferable in accordance with aspects of the present invention that the area percentage of martensitic phase relative to the whole steel pipe is preferably 70% or more, and is preferably 95% or less. The area percentage of martensitic phase is more preferably 80% or more, and is more preferably 90% or less.

In view of reducing decrease of corrosion resistance and hot workability, the area percentage of phases other than the primary phase is preferably less than 30% of the whole steel pipe. The area percentage of phases other than the primary phase is more preferably 25% or less, even more preferably 20% or less. The retained austenite phase is preferably less than 30% because excessively high fractions of retained austenite phase leads to decrease of strength. The ferrite phase is more preferably 5% or less because a ferrite phase causes decrease of hot workability.

The microstructure can be measured as follows. First, a test specimen for microstructure observation is corroded with a Vilella's solution (a mixed reagent containing picric acid, hydrochloric acid, and ethanol in proportions of 2 g, 10 ml, and 100 ml, respectively), and the structure is imaged with a scanning electron microscope (1,000×). The fraction of the ferrite phase (area percent) in the microstructure is then calculated using an image analyzer.

Separately, an X-ray diffraction test specimen is ground and polished to have a measurement cross section (C cross section) orthogonal to the axial direction of pipe, and the amount of retained austenite (γ) is measured by an X-ray diffraction method. The amount of retained austenite is determined by measuring X-ray diffraction integral intensity for the (220) plane of the γ phase, and the (211) plane of the α phase, and converting the calculated values using the following formula. Here, the volume fraction of retained austenite is regarded as an area percentage.

$$\gamma \text{ (volume fraction)} = 100/(1+(I\alpha R\gamma/I\gamma R\alpha)),$$

wherein Iα is the integral intensity of α, Rα is the crystallographic theoretical value for α, Iγ is the integral intensity of γ, and Rγ is the crystallographic theoretical value for γ.

The fraction (area percent) of martensitic phase (tempered martensitic phase) is the remainder other than the ferrite phase and the retained γ phase.

In accordance with aspects of the present invention, the prior austenite has an average grain size of 40 μm or less. The desired low-temperature SSC resistance cannot be obtained when the average grain size of prior austenite is more than 40 μm. As noted above, a smaller prior austenite grain size means a larger grain boundary area per unit volume, and the concentrations of phosphorus and sulfur that segregate at prior austenite grain boundaries decrease when the prior austenite grain size is smaller. As a result, the SSC resistance can improve. The average grain size of prior austenite is preferably 30 μm or less. The average grain size of prior austenite can be measured using the method described in the Examples section below.

The following describes an embodiment of a method for manufacturing a high-strength stainless steel seamless pipe for oil country tubular goods according to aspects of the present invention.

In the descriptions of the manufacturing method below, the temperatures (C) refer to surface temperatures of a steel pipe material and a steel pipe (a seamless steel pipe after pipe making), unless otherwise specifically stated. The surface temperatures can be measured using a radiation thermometer or the like.

In accordance with aspects of the present invention, a steel pipe material of the composition described above is used as a starting material. The method of manufacture of a steel pipe material used as a starting material is not particularly limited. For example, a molten steel of the foregoing composition is made using a common steelmaking process such as by using a converter, and formed into a steel pipe material, for example, a billet, using an ordinary method such as continuous casting or ingot casting-billeting.

The steel pipe material is heated, and formed into a hollow blank with a piercer, using a common pipe making process such as the Mannesmann-plug mill process or Mannesmann-mandrel mill process. This is followed by hot working to produce a seamless steel pipe having the foregoing composition and desired dimensions (predetermined shape). The seamless steel pipe may be produced by hot extrusion using a pressing method.

In the steel pipe material heating step, the heating temperature ranges from 1,100 to 1,350° C. A heating temperature of less than 1, 100° C. decreases hot workability, and produces large numbers of defects during pipe making. A high heating temperature of more than 1, 350° C. causes coarsening of crystal grains, and decreases low-temperature toughness. With such a high heating temperature, it might not be possible to obtain a microstructure having an average crystal grain size falling in the foregoing ranges. For these reasons, the heating temperature in the heating step is 1,100 to 1,350° C. The heating temperature is preferably 1, 150° C. or more, and is preferably 1,300° C. or less.

Preferably, the seamless steel pipe formed is cooled to room temperature at cooling rate of air cooling or faster. In this way, the steel pipe can have a microstructure containing a martensitic phase as a primary phase.

In order to appropriately control the average grain size of prior austenite within the foregoing ranges, it is preferable that the value calculated by (cross sectional area of the steel pipe formed)/(cross sectional area of the steel pipe material) be 0.20 or less in forming the seamless steel pipe (steel pipe) of desired dimensions. It is also preferable that the value calculated by (cross sectional area of the steel pipe formed)/(cross sectional area of the steel pipe after piercing) be 0.40 or less.

Here, "cross sectional area of steel pipe material", "cross sectional area of the steel pipe formed", and "cross sectional area of the steel pipe after piercing" are cross sectional areas orthogonal to the axial direction of the pipe.

In accordance with aspects of the present invention, the cooling of the steel pipe to room temperature at a cooling rate of air cooling or faster is followed by quenching, in which the steel pipe (seamless steel pipe after pipe making) is reheated to at least an $AC_3$ transformation point and not more than 1,050° C., and cooled to 100° C. or less (cooling stop temperature) at a cooling rate of air cooling or faster. In this way, the martensitic phase can be refined while achieving high strength.

Here, "cooling rate of air cooling or faster" means 0.01° C./s or faster.

In view of preventing coarsening of the microstructure and providing the desired grain size for prior austenite, the quenching heating temperature (reheating temperature) is preferably 800 to 1,050° C. The quenching heating temperature is more preferably 900° C. or more, and is more preferably 960° C. or less. In view of ensuring soaking, the reheating temperature is retained for preferably at least 5 minutes. The retention time is preferably at most 30 minutes. In view of providing the desired yield strength (YS), the cooling stop temperature is 100° C. or less. The cooling stop temperature is preferably 25° C. or less to satisfy a YS of 1,034 MPa or more (150 ksi or more).

The steel pipe is tempered after quenching. In tempering, the steel pipe is heated to a temperature of 500° C. or more and not more than an $Ac_1$ transformation point (tempering temperature), and air cooled after being held for a predetermined time period.

When the tempering temperature is higher than the $Ac_1$ transformation point, the fresh martensitic phase precipitates after tempering, and the desired high strength cannot be provided. When the tempering temperature is less than 500° C., the strength overly increases, and it becomes difficult to obtain the desired sulfide stress cracking resistance. For these reasons, the tempering temperature is 500° C. or more and not more than an Ac transformation point. In this way, the microstructure can have a tempered martensitic phase as a primary phase, and the seamless steel pipe can have the desired strength and the desired corrosion resistance. The tempering temperature is preferably 530° C. or more, and is preferably 600° C. or less. The tempering temperature is preferably 560° C. or less to provide a YS of 1,034 MPa or more (150 ksi or more).

In view of ensuring soaking of the material, the tempering temperature is retained for preferably at least 10 minutes. The retention time is preferably at most 90 minutes.

In accordance with aspects of the present invention, in view of more appropriately controlling the average grain size of prior austenite within the foregoing ranges, it is preferable to perform quenching-tempering at least twice. Desirably, quenching-tempering is repeated at most three times because the effect becomes saturated even when quenching-tempering is repeated more than three times.

The $Ac_3$ transformation point and $Ac_1$ transformation point are values actually measured from changes in the expansion rate of a test specimen (Ø=3 mm×L=10 mm) upon heating at 15° C./min and cooling.

While the seamless steel pipe has been described using examples, the present invention is not limited to these. For example, a steel pipe for oil country tubular goods may be produced by forming a steel pipe material of the foregoing composition into an electric resistance welded steel pipe or a UOE steel pipe using ordinary processes. In this case, a stainless steel pipe according to aspects of the present invention can be obtained by quenching and tempering such a steel pipe for oil country tubular goods under the conditions described above.

As described above, aspects of the present invention can provide a high-strength stainless steel seamless pipe for oil country tubular goods having superior hot workability, excellent carbon dioxide gas corrosion resistance, and excellent SSC resistance in low-temperature environments while having high strength with a yield strength YS of 758 MPa or more. By appropriately controlling the cooling stop temperature in quenching, aspects of the present invention have enabled production of a high-strength stainless steel seamless pipe for oil country tubular goods having improved hot workability, improved carbon dioxide gas corrosion resistance, and improved SSC resistance over the related art while ensuring higher strength with a YS of 1,034 MPa or more.

EXAMPLES

Aspects of the present invention are described below through Examples. It is to be noted that the present invention is not limited by the following Examples.

Molten steels of the compositions shown in Table 1 were made using a converter, and cast into billets (steel pipe materials) by continuous casting. The steel pipe material was heated at the heating temperature shown in Table 2-1 and Table 2-2, and hot worked into a steel pipe using a seamless rolling mill. The steel pipe was then air cooled to produce a seamless steel pipe. Table 2-1 and Table 2-2 show the dimensions of the seamless steel pipes produced. In Table 2-1 and Table 2-2, "cross sectional area ratio" is a value calculated from the value of (cross sectional area of the steel pipe formed/cross sectional area of a billet) and the value of (cross sectional area of the steel pipe formed/cross sectional area of the steel pipe after piercing).

The seamless steel pipe was cut to prepare a test specimen material. The test specimen material from each seamless steel pipe was subjected to quenching in which the test specimen material was heated at the heating temperature (reheating temperature) for the duration of the soaking time shown in Table 2-1 and Table 2-2, and air cooled to the cooling stop temperature shown in Table 2-1 and Table 2-2. This was followed by tempering in which the test specimen material was heated at the tempering temperature for the duration of the soaking time shown in Table 2-1 and Table 2-2, and air cooled. For some test specimen materials (steel pipe Nos. 2, 4, 28, and 30), quenching-tempering was repeated twice under the conditions shown in Table 2-1 and Table 2-2.

The test specimen material was evaluated for tensile properties, corrosion characteristics, SSC resistance, and hot workability, using the methods described below. The test specimen material was also measured for grain size of prior austenite, and microstructure, as follows.

Evaluation of Tensile Properties

An arc-shaped tensile test specimen in compliance with API (American Petroleum Institute) was taken from the quenched and tempered test specimen material, and was subjected to a tensile test as specified by API to determine tensile properties (yield strength YS, tensile strength TS). The test specimen was considered as having passed the test when it had a yield strength YS of 758 MPa or more, and having failed the test when the yield strength YS was 757 MPa or less.

Evaluation of Corrosion Characteristics

A corrosion test specimen measuring 3 mm in thickness, 30 mm in width, and 40 mm in length was prepared by machining the quenched and tempered test specimen material, and was subjected to a corrosion test.

The corrosion test was conducted by immersing the test specimen for 14 days in a test solution (a 20 mass % NaCl aqueous solution; liquid temperature: 180° C.; an atmosphere of 10 atm $CO_2$ gas) kept in an autoclave. The corrosion rate was determined from the calculated reduction in the weight of the tested specimen measured before and after the corrosion test. Here, the steel was considered as having passed the test when it had a corrosion rate of 0.125 mm/y or less, and having failed the test when the corrosion rate was more than 0.125 mm/y.

The test specimen after the corrosion test was observed for the presence or absence of pitting corrosion on its surface, using a loupe at 10 times magnification. Here, pitting corrosion is present when pitting corrosion of a diameter equal to or greater than 0.2 mm was observed. In the test, the test specimen was considered as having passed the test when it did not have pitting corrosion ("Absent" under the heading "Pitting corrosion" in Table 3), and having failed the test when it had pitting corrosion ("Present" under the heading "Pitting corrosion" in Table 3).

The test specimen was determined as having desirable carbon dioxide gas corrosion resistance when the corrosion rate evaluated as above was 0.125 mm/y or less, and pitting corrosion was absent.

Evaluation of SSC Resistance

An SSC test (sulfide stress cracking test) was conducted in compliance with NACE TM0177, Method A.

For test specimens that had a YS of less than 1,034 MPa (less than 150 ksi), the test was carried out in a test environment using an aqueous solution prepared by adjusting the pH of a 5 mass % NaCl aqueous solution (liquid temperature: 4° C., $H_2S$: 0.02 bar, $CO_2$: 0.98 bar) to 4.0 by addition of 0.5 mass % acetic acid and sodium acetate, and the test specimen was immersed in the solution for 720 hours under an applied stress 90% of the yield stress. The test specimen was considered as having passed the test when it did not have a crack after the test ("Absent" under the heading "SSC" in Table 3), and having failed the test when the test specimen had a crack after the test ("Present" under the heading "SSC" in Table 3).

For test specimens that had a YS of 1,034 MPa or more (150 ksi or more), the test was carried out in a test environment using an aqueous solution prepared by adjusting the pH of a 5 mass % NaCl aqueous solution (liquid temperature: 4° C., $H_2S$: 0.02 bar, $CO_2$: 0.98 bar) to 4.5 by addition of 0.5 mass % acetic acid and sodium acetate, and the test specimen was immersed in the solution for 720 hours under an applied stress 90% of the yield stress. The test specimens were evaluated using the same criteria described above.

The test specimen was determined as having desirable SSC resistance in low-temperature environments when it did not have a crack in the evaluation described above.

Evaluation of Hot Workability

For evaluation of hot workability, a round rod-shaped smooth test specimen having a diameter of 10 mm at a parallel portion was heated to 1, 250° C. with a Gleeble tester, and was stretched to break after being held at the heated temperature for 100 seconds, cooled to 1,000° C. at 1° C./see, and held for 10 seconds at this temperature to measure a percentage reduction (%) of cross section. The test specimen was considered as having superior hot workability and having passed the test when it had a percentage reduction of cross section of 70% or more. Test specimens that had a percentage reduction of cross section of less than 70% were considered as having failed the test.

The test specimen was determined as having superior hot workability when the percentage reduction of cross section was 70% or more in the evaluation described above.

Measurement of Average Grain Size of Prior Austenite

A specimen for prior austenite measurement was taken from a cross section at an end of the pipe, orthogonal to the longitudinal direction of the pipe, specifically from an arbitrarily chosen circumferential location half the thickness of the wall from the outer surface of the pipe. After EBSD observation of the specimen, prior austenite grains were reconstructed from data from the EBSD observation, using reconstruction analysis software designed for analysis of prior austenite grains. In the reconstructed image of prior austenite grains, three lines, 300-μm long each, were drawn at 500-μm intervals along the pipe circumference, and an average of prior austenite grain sizes was taken using the intercept method. The calculated average was then determined as the average grain size of prior austenite.

Measurement of Microstructure

For measurement of microstructure, a test specimen for microstructure observation was prepared from the quenched and tempered test specimen material. The test specimen for microstructure observation was corroded with a Vilella's solution (a mixed reagent containing picric acid, hydrochloric acid, and ethanol in proportions of 2 g, 10 ml, and 100 ml, respectively), and the microstructure was imaged with a scanning electron microscope (1,000×). The fraction of the ferrite phase (area percent) in the microstructure was then calculated using an image analyzer.

Separately, an X-ray diffraction test specimen was ground and polished to have a measurement cross section (C cross section) orthogonal to the axial direction of pipe, and the amount of retained austenite (γ) was measured by an X-ray diffraction method. The amount of retained austenite was determined by measuring X-ray diffraction integral intensity for the (220) plane of the γ phase, and the (211) plane of the α phase, and converting the calculated values using the following formula. Here, the volume fraction of retained austenite was regarded as an area percentage.

$$\gamma(\text{volume fraction})=100/(1+(I\alpha R\gamma/I\gamma R\alpha)),$$

wherein Iα was the integral intensity of α, Rα was the crystallographic theoretical value for α, Iγ was the integral intensity of γ, and Rγ was the crystallographic theoretical value for γ.

The fraction (area percent) of martensitic phase (tempered martensitic phase) was the remainder other than the ferrite phase and the retained γ phase.

The results were presented in Table 3-1 and Table 3-2.

TABLE 1

| Steel type | Composition (mass %) | | | | | | | | | | | | | | Value on left-hand side of formula | Value on left-hand side of formula |
|---|---|---|---|---|---|---|---|---|---|---|---|---|---|---|---|---|
| No | C | Si | Mn | P | S | Cr | Ni | Mo | Al | V | Co | N | O | Selective addition | (1) *1 | (2)*2 |
| A | 0.018 | 0.29 | 0.44 | 0.024 | 0.0011 | 14.9 | 5.4 | 1.8 | 0.012 | 0.033 | 0.14 | 0.086 | 0.0012 | — | 19.1 | 9.7 |
| B | 0.019 | 0.29 | 0.46 | 0.022 | 0.0011 | 15.1 | 5.4 | 1.6 | 0.010 | 0.044 | 0.93 | 0.077 | 0.0012 | — | 19.2 | 9.7 |
| C | 0.028 | 0.17 | 0.34 | 0.022 | 0.0012 | 14.2 | 6.0 | 1.7 | 0.009 | 0.041 | 0.05 | 0.072 | 0.0019 | Cu: 0.68, Nb: 0.06 | 18.9 | 7.8 |
| D | 0.016 | 0.28 | 0.44 | 0.024 | 0.0010 | 15.3 | 5.6 | 1.8 | 0.011 | 0.040 | 0.05 | 0.091 | 0.0011 | Cu: 0.74 | 20.1 | 9.7 |
| E | 0.015 | 0.19 | 0.38 | 0.019 | 0.0010 | 16.3 | 6.3 | 2.3 | 0.021 | 0.072 | 0.07 | 0.041 | 0.0053 | Cu: 1.21, Nb: 0.04, Ti: 0.087, B: 0.001 | 22.1 | 10.8 |
| F | 0.023 | 0.19 | 0.37 | 0.022 | 0.0011 | 14.7 | 6.0 | 2.0 | 0.009 | 0.037 | 0.07 | 0.053 | 0.0017 | Nb: 0.062 | 19.3 | 9.1 |
| G | 0.019 | 0.20 | 0.38 | 0.021 | 0.0011 | 14.6 | 6.3 | 1.9 | 0.009 | 0.043 | 0.05 | 0.069 | 0.0019 | Nb: 0.06, Ca: 0.0018, REM: 0.0035 | 19.5 | 8.7 |
| H | 0.028 | 0.19 | 0.32 | 0.022 | 0.0009 | 14.6 | 6.1 | 2.1 | 0.009 | 0.042 | 0.05 | 0.046 | 0.0021 | Cu: 0.6, Nb: 0.099, Ca: 0.0022, REM: 0.0037 | 19.6 | 8.7 |
| I | 0.017 | 0.29 | 0.50 | 0.024 | 0.0010 | 15.5 | 5.8 | 1.9 | 0.012 | 0.042 | 0.63 | 0.081 | 0.0012 | Sn: 0.11 | 20.1 | 10.0 |
| J | 0.013 | 0.17 | 0.34 | 0.022 | 0.0009 | 16.3 | 6.9 | 2.9 | 0.017 | 0.084 | 0.07 | 0.050 | 0.0049 | Cu: 1.24, Nb: 0.038, Ti: 0.089 | 22.9 | 10.8 |
| K | 0.057 | 0.22 | 0.43 | 0.010 | 0.0009 | 16.9 | 6.9 | 1.6 | 0.020 | 0.049 | 0.06 | 0.108 | 0.0035 | — | 21.2 | 8.1 |
| L | 0.018 | 0.28 | 0.52 | 0.021 | 0.0009 | 14.3 | 3.7 | 1.8 | 0.010 | 0.050 | 0.05 | 0.074 | 0.0012 | — | 17.4 | 10.8 |
| M | 0.018 | 0.32 | 0.46 | 0.021 | 0.0009 | 15.4 | 5.3 | 1.8 | 0.011 | 0.044 | 1.15 | 0.098 | 0.0011 | — | 19.6 | 10.2 |
| N | 0.006 | 0.21 | 0.67 | 0.008 | 0.0010 | 13.4 | 6.1 | 1.6 | 0.018 | 0.019 | — | 0.007 | 0.0029 | — | 18.2 | 8.4 |
| O | 0.015 | 0.14 | 0.35 | 0.019 | 0.0009 | 16.0 | 5.1 | 2.4 | 0.025 | 0.078 | 0.06 | 0.041 | 0.0038 | — | 20.5 | 12.2 |
| P | 0.061 | 0.25 | 0.46 | 0.011 | 0.0009 | 17.7 | 6.4 | 1.7 | 0.021 | 0.041 | 0.05 | 0.116 | 0.0035 | Cu: 0.77, Ti: 0.174 | 22.1 | 9.0 |
| Q | 0.014 | 0.17 | 0.38 | 0.021 | 0.0011 | 15.3 | 6.5 | 2.3 | 0.020 | 0.074 | — | 0.043 | 0.0041 | Cu: 1.18, Nb: 0.032, Ti: 0.084 | 21.3 | 9.7 |
| R | 0.006 | 0.19 | 0.71 | 0.008 | 0.0010 | 13.4 | 6.3 | 1.5 | 0.019 | 0.016 | — | 0.009 | 0.0028 | Cu: 1.14, Ti: 0.073 | 18.9 | 7.7 |
| S | 0.016 | 0.16 | 0.43 | 0.019 | 0.0009 | 16.3 | 5.4 | 2.7 | 0.021 | 0.076 | 0.08 | 0.038 | 0.0047 | Cu: 1.3, Nb: 0.04, Ti: 0.059, B: 0.001 | 21.8 | 12.1 |
| T | 0.020 | 0.29 | 0.50 | 0.023 | 0.0011 | 15.4 | 5.5 | 1.7 | 0.012 | 0.028 | 0.13 | 0.086 | 0.0013 | Ta: 0.03, Mg: 0.0030 | 19.6 | 9.8 |
| U | 0.021 | 0.32 | 0.38 | 0.026 | 0.0012 | 15.3 | 5.3 | 1.8 | 0.012 | 0.025 | 0.13 | 0.081 | 0.0013 | W: 1.0 | 19.4 | 10.1 |
| V | 0.020 | 0.32 | 0.47 | 0.026 | 0.0009 | 15.0 | 5.6 | 1.8 | 0.012 | 0.029 | 0.16 | 0.084 | 0.0010 | Zr: 0.05 | 19.3 | 9.5 |
| W | 0.019 | 0.27 | 0.44 | 0.023 | 0.0010 | 14.7 | 5.6 | 1.7 | 0.010 | 0.034 | 0.13 | 0.084 | 0.0010 | Sb: 0.03 | 19.0 | 9.5 |

*1 $Cr + 0.65Ni + 0.6Mo + 0.55Cu - 20C \geq 18.5$ . . . (1)

*2 $Cr + Mo + 0.3Si - 43.3C - 0.4Mn - Ni - 0.3Cu - 9N \leq 11$ . . . (2)

TABLE 2-1

| Steel pipe No. | Steel type No. | Dimensions of steel pipe: Outer diameter (mm) | Dimensions of steel pipe: Wall thickness (mm) | Cross sectional area ratio: Cross sectional area of steel pipe formed/cross sectional area of steel pipe material | Cross sectional area ratio: Cross sectional area of steel pipe formed/cross sectional area of steel pipe after piercing | $Ac_1$ transformation point (° C.) | $Ac_3$ transformation point (° C.) | Steel pipe material heating temp. (° C.) |
|---|---|---|---|---|---|---|---|---|
| 1 | A | 88.9 | 6.45 | 0.059 | 0.157 | 767 | 859 | 1273 |
| 2 | A | 88.9 | 6.45 | 0.059 | 0.157 | 767 | 859 | 1262 |
| 3 | B | 88.9 | 6.45 | 0.059 | 0.157 | 777 | 865 | 1249 |
| 4 | B | 88.9 | 6.45 | 0.059 | 0.157 | 777 | 865 | 1270 |
| 5 | C | 73.02 | 11.18 | 0.077 | 0.166 | 664 | 784 | 1262 |
| 6 | D | 114.3 | 12.7 | 0.143 | 0.296 | 772 | 869 | 1272 |
| 7 | E | 88.9 | 6.45 | 0.059 | 0.157 | 811 | 900 | 1225 |
| 8 | F | 101.6 | 15.49 | 0.148 | 0.300 | 724 | 820 | 1228 |
| 9 | F | 101.6 | 15.49 | 0.148 | 0.300 | 724 | 820 | 1245 |
| 10 | G | 73.02 | 11.18 | 0.077 | 0.166 | 695 | 793 | 1241 |
| 11 | H | 73.02 | 11.18 | 0.141 | 0.450 | 704 | 814 | 1266 |
| 12 | I | 114.3 | 12.7 | 0.143 | 0.296 | 790 | 869 | 1249 |
| 13 | I | 114.3 | 12.7 | 0.263 | 0.296 | 790 | 869 | 1265 |
| 14 | J | 88.9 | 6.45 | 0.059 | 0.157 | 804 | 906 | 1242 |
| 15 | K | 88.9 | 6.45 | 0.059 | 0.157 | 815 | 872 | 1239 |
| 16 | L | 101.6 | 15.49 | 0.148 | 0.300 | 819 | 901 | 1273 |
| 17 | M | 73.02 | 11.18 | 0.077 | 0.166 | 820 | 892 | 1232 |
| 18 | N | 114.3 | 12.7 | 0.143 | 0.296 | 612 | 750 | 1264 |
| 19 | O | 101.6 | 15.49 | 0.148 | 0.300 | 806 | 913 | 1258 |
| 20 | P | 73.02 | 11.18 | 0.077 | 0.166 | 807 | 916 | 1254 |
| 21 | Q | 114.3 | 12.7 | 0.143 | 0.296 | 770 | 895 | 1242 |
| 22 | R | 101.6 | 15.49 | 0.148 | 0.300 | 607 | 750 | 1258 |
| 23 | S | 101.6 | 15.49 | 0.148 | 0.300 | 801 | 911 | 1266 |
| 24 | T | 88.9 | 6.45 | 0.059 | 0.157 | 794 | 876 | 1263 |
| 25 | U | 88.9 | 6.45 | 0.059 | 0.157 | 808 | 891 | 1265 |

| Steel pipe No. | Steel type No. | Heat treatment (first): Quenching: Heating temp. (° C.) | Quenching: Soaking time (min) | Quenching: Cooling | Quenching: Cooling stop temp. (° C.) | Tempering: Tempering temp. (° C.) | Tempering: Soaking time (min) | Tempering: Cooling |
|---|---|---|---|---|---|---|---|---|
| 1 | A | 890 | 20 | Air cooling | 30 | 530 | 20 | Air cooling |
| 2 | A | 890 | 20 | Air cooling | 30 | 530 | 20 | Air cooling |
| 3 | B | 890 | 20 | Air cooling | 30 | 530 | 20 | Air cooling |
| 4 | B | 890 | 20 | Air cooling | 30 | 530 | 20 | Air cooling |
| 5 | C | 890 | 20 | Air cooling | 30 | 530 | 20 | Air cooling |
| 6 | D | 890 | 20 | Air cooling | 30 | 530 | 20 | Air cooling |
| 7 | E | 960 | 20 | Air cooling | 30 | 580 | 20 | Air cooling |
| 8 | F | 890 | 20 | Air cooling | 30 | 530 | 20 | Air cooling |
| 9 | F | 1060 | 20 | Air cooling | 30 | 530 | 20 | Air cooling |
| 10 | G | 890 | 20 | Air cooling | 30 | 530 | 20 | Air cooling |
| 11 | H | 890 | 20 | Air cooling | 30 | 530 | 20 | Air cooling |
| 12 | I | 890 | 20 | Air cooling | 30 | 530 | 20 | Air cooling |
| 13 | I | 890 | 20 | Air cooling | 30 | 530 | 20 | Air cooling |
| 14 | J | 960 | 20 | Air cooling | 30 | 580 | 20 | Air cooling |
| 15 | K | 920 | 20 | Air cooling | 30 | 580 | 20 | Air cooling |
| 16 | L | 910 | 20 | Air cooling | 30 | 530 | 20 | Air cooling |
| 17 | M | 910 | 20 | Air cooling | 30 | 530 | 20 | Air cooling |
| 18 | N | 810 | 20 | Air cooling | 25 | 600 | 40 | Air cooling |
| 19 | O | 920 | 20 | Air cooling | 30 | 580 | 20 | Air cooling |
| 20 | P | 920 | 20 | Air cooling | 30 | 580 | 20 | Air cooling |
| 21 | Q | 960 | 20 | Air cooling | 30 | 580 | 20 | Air cooling |
| 22 | R | 810 | 20 | Air cooling | 25 | 600 | 40 | Air cooling |
| 23 | S | 920 | 20 | Air cooling | 30 | 580 | 20 | Air cooling |
| 24 | T | 890 | 20 | Air cooling | 30 | 530 | 20 | Air cooling |
| 25 | U | 900 | 20 | Air cooling | 50 | 530 | 88 | Air cooling |

TABLE 2-1-continued

| | | Heat treatment (second) | | | | | | |
|---|---|---|---|---|---|---|---|---|
| | | Quenching | | | | Tempering | | |
| Steel pipe No. | Steel type No. | Heating temp. (° C.) | Soaking time (min) | Cooling | Cooling stop temp. (° C.) | Tempering temp. (° C.) | Soaking time (min) | Cooling |
| 1 | A | | | | | | | |
| 2 | A | 890 | 20 | Air cooling | 30 | 530 | 20 | Air cooling |
| 3 | B | | | | | | | |
| 4 | B | 890 | 20 | Air cooling | 30 | 530 | 20 | Air cooling |
| 5 | C | | | | | | | |
| 6 | D | | | | | | | |
| 7 | E | | | | | | | |
| 8 | F | | | | | | | |
| 9 | F | | | | | | | |
| 10 | G | | | | | | | |
| 11 | H | | | | | | | |
| 12 | I | | | | | | | |
| 13 | I | | | | | | | |
| 14 | J | | | | | | | |
| 15 | K | | | | | | | |
| 16 | L | | | | | | | |
| 17 | M | | | | | | | |
| 18 | N | | | | | | | |
| 19 | O | | | | | | | |
| 20 | P | | | | | | | |
| 21 | Q | | | | | | | |
| 22 | R | | | | | | | |
| 23 | S | | | | | | | |
| 24 | T | | | | | | | |
| 25 | U | | | | | | | |

TABLE 2-2

| | | | | Cross sectional area ratio | | | | |
|---|---|---|---|---|---|---|---|---|
| | | Dimensions of steel pipe | | | | | | |
| Steel pipe No. | Steel type No. | Outer diameter (mm) | Wall thickness (mm) | Cross sectional area of steel pipe formed/ cross sectional area of steel pipe material | Cross sectional area of steel pipe formed/ cross sectional area of steel pipe after piercing | $Ac_1$ transformation point (° C.) | $Ac_3$ transformation point (° C.) | Steel pipe material heating temp. (° C.) |
| 26 | V | 88.9 | 6.45 | 0.059 | 0.157 | 762 | 852 | 1267 |
| 27 | A | 88.9 | 6.45 | 0.059 | 0.157 | 767 | 859 | 1273 |
| 28 | A | 88.9 | 6.45 | 0.059 | 0.157 | 767 | 859 | 1262 |
| 29 | B | 88.9 | 6.45 | 0.059 | 0.157 | 777 | 865 | 1249 |
| 30 | B | 88.9 | 6.45 | 0.059 | 0.157 | 777 | 865 | 1270 |
| 31 | C | 73.02 | 11.18 | 0.077 | 0.166 | 664 | 784 | 1262 |
| 32 | D | 114.3 | 12.7 | 0.143 | 0.296 | 772 | 869 | 1272 |
| 33 | E | 88.9 | 6.45 | 0.059 | 0.157 | 811 | 900 | 1225 |
| 34 | F | 101.6 | 15.49 | 0.148 | 0.300 | 724 | 820 | 1228 |
| 35 | F | 101.6 | 15.49 | 0.148 | 0.300 | 724 | 820 | 1245 |
| 36 | G | 73.02 | 11.18 | 0.077 | 0.166 | 695 | 793 | 1241 |
| 37 | H | 73.02 | 11.18 | 0.077 | 0.166 | 704 | 814 | 1266 |
| 38 | I | 114.3 | 12.7 | 0.143 | 0.296 | 790 | 869 | 1249 |
| 39 | I | 114.3 | 12.7 | 0.143 | 0.296 | 790 | 869 | 1265 |
| 40 | J | 88.9 | 6.45 | 0.059 | 0.157 | 804 | 906 | 1242 |
| 41 | K | 88.9 | 6.45 | 0.059 | 0.157 | 815 | 872 | 1239 |
| 42 | L | 101.6 | 15.49 | 0.148 | 0.300 | 819 | 901 | 1273 |
| 43 | M | 73.02 | 11.18 | 0.077 | 0.166 | 820 | 892 | 1232 |
| 44 | N | 114.3 | 12.7 | 0.143 | 0.296 | 612 | 750 | 1264 |
| 45 | P | 73.02 | 11.18 | 0.077 | 0.166 | 807 | 916 | 1254 |
| 46 | Q | 114.3 | 12.7 | 0.143 | 0.296 | 770 | 895 | 1242 |
| 47 | R | 101.6 | 15.49 | 0.148 | 0.300 | 607 | 750 | 1258 |
| 48 | A | 88.9 | 6.45 | 0.059 | 0.157 | 767 | 859 | 1369 |
| 49 | W | 88.9 | 6.45 | 0.059 | 0.157 | 769 | 858 | 1273 |

TABLE 2-2-continued

| | | Heat treatment (first) | | | | | | |
|---|---|---|---|---|---|---|---|---|
| | | Quenching | | | | Tempering | | |
| Steel pipe No. | Steel type No. | Heating temp. (° C.) | Soaking time (min) | Cooling | Cooling stop temp. (° C.) | Tempering temp. (° C.) | Soaking time (min) | Cooling |
| 26 | V | 890 | 20 | Air cooling | 90 | 530 | 11 | Air cooling |
| 27 | A | 890 | 20 | Air cooling | 15 | 530 | 20 | Air cooling |
| 28 | A | 890 | 20 | Air cooling | 15 | 530 | 20 | Air cooling |
| 29 | B | 890 | 20 | Air cooling | 15 | 530 | 20 | Air cooling |
| 30 | B | 890 | 20 | Air cooling | 15 | 530 | 20 | Air cooling |
| 31 | C | 890 | 20 | Air cooling | 10 | 530 | 20 | Air cooling |
| 32 | D | 890 | 20 | Air cooling | 15 | 530 | 20 | Air cooling |
| 33 | E | 960 | 20 | Air cooling | 15 | 530 | 20 | Air cooling |
| 34 | F | 890 | 20 | Air cooling | 10 | 530 | 20 | Air cooling |
| 35 | F | 1060 | 20 | Air cooling | 15 | 530 | 20 | Air cooling |
| 36 | G | 890 | 20 | Air cooling | 10 | 530 | 20 | Air cooling |
| 37 | H | 890 | 20 | Air cooling | 10 | 530 | 20 | Air cooling |
| 38 | I | 890 | 20 | Air cooling | 15 | 530 | 20 | Air cooling |
| 39 | I | 890 | 20 | Air cooling | 20 | 530 | 20 | Air cooling |
| 40 | J | 960 | 20 | Air cooling | 10 | 580 | 20 | Air cooling |
| 41 | K | 920 | 20 | Air cooling | 15 | 580 | 20 | Air cooling |
| 42 | L | 910 | 20 | Air cooling | 15 | 530 | 20 | Air cooling |
| 43 | M | 910 | 20 | Air cooling | 15 | 530 | 20 | Air cooling |
| 44 | N | 810 | 20 | Air cooling | 25 | 600 | 40 | Air cooling |
| 45 | P | 920 | 20 | Air cooling | 30 | 580 | 20 | Air cooling |
| 46 | Q | 960 | 20 | Air cooling | 30 | 580 | 20 | Air cooling |
| 47 | R | 810 | 20 | Air cooling | 25 | 600 | 40 | Air cooling |
| 48 | A | 890 | 20 | Air cooling | 30 | 530 | 20 | Air cooling |
| 49 | W | 890 | 20 | Air cooling | 15 | 530 | 20 | Air cooling |

| | | Heat treatment (second) | | | | | | |
|---|---|---|---|---|---|---|---|---|
| | | Quenching | | | | Tempering | | |
| Steel pipe No. | Steel type No. | Heating temp. (° C.) | Soaking time (min) | Cooling | Cooling stop temp. (° C.) | Tempering temp. (° C.) | Soaking time (min) | Cooling |
| 26 | V | | | | | | | |
| 27 | A | | | | | | | |
| 28 | A | 890 | 20 | Air cooling | 30 | 530 | 20 | Air cooling |
| 29 | B | | | | | | | |
| 30 | B | 890 | 20 | Air cooling | 30 | 530 | 20 | Air cooling |
| 31 | C | | | | | | | |
| 32 | D | | | | | | | |
| 33 | E | | | | | | | |
| 34 | F | | | | | | | |
| 35 | F | | | | | | | |
| 36 | G | | | | | | | |
| 37 | H | | | | | | | |
| 38 | I | | | | | | | |
| 39 | I | | | | | | | |
| 40 | J | | | | | | | |
| 41 | K | | | | | | | |
| 42 | L | | | | | | | |
| 43 | M | | | | | | | |
| 44 | N | | | | | | | |
| 45 | P | | | | | | | |
| 46 | Q | | | | | | | |
| 47 | R | | | | | | | |
| 48 | A | | | | | | | |
| 49 | W | | | | | | | |

TABLE 3

| Steel pipe No. | Steel type No. | Microstructure: Average grain size of prior austenite (μm) | Microstructure: Martensitic phase (tempered martensitic phase) ( Area %) | Microstructure: Retained austenite phase (Area %) | Microstructure: Ferrite phase (Area %) | Hot workability: Percentage reduction of cross section (%) | Tensile properties: Yield strength YS (MPa) | Tensile properties: Tensile strength TS (MPa) | Corrosion characteristics: Corrosion rate (mm/y) | Corrosion characteristics: Pitting corrosion | Corrosion characteristics: SSC | Remarks |
|---|---|---|---|---|---|---|---|---|---|---|---|---|
| 1 | A | 9.9 | 99 | 0 | 1 | 72 | 972 | 1209 | 0.062 | Absent | Absent | Present Example |
| 2 | A | 7.3 | 100 | 0 | 0 | 77 | 975 | 1213 | 0.064 | Absent | Absent | Present Example |
| 3 | B | 9.7 | 100 | 0 | 0 | 77 | 990 | 1207 | 0.074 | Absent | Absent | Present Example |
| 4 | B | 8.3 | 100 | 0 | 0 | 78 | 974 | 1187 | 0.075 | Absent | Absent | Present Example |
| 5 | C | 11.7 | 100 | 0 | 0 | 79 | 933 | 1166 | 0.078 | Absent | Absent | Present Example |
| 6 | D | 25.6 | 92 | 8 | 0 | 73 | 979 | 1179 | 0.063 | Absent | Absent | Present Example |
| 7 | E | 9.6 | 82 | 14 | 4 | 84 | 776 | 924 | 0.022 | Absent | Absent | Present Example |
| 8 | F | 31.1 | 100 | 0 | 0 | 85 | 930 | 1163 | 0.070 | Absent | Absent | Present Example |
| 9 | F | 46.3 | 100 | 0 | 0 | 86 | 941 | 1177 | 0.060 | Absent | Present | Comparative Example |
| 10 | G | 12.8 | 100 | 0 | 0 | 71 | 896 | 1119 | 0.068 | Absent | Absent | Present Example |
| 11 | H | 37.4 | 100 | 0 | 0 | 85 | 871 | 1075 | 0.055 | Absent | Absent | Present Example |
| 12 | I | 26.3 | 91 | 7 | 2 | 73 | 966 | 1175 | 0.056 | Absent | Absent | Present Example |
| 13 | I | 36.9 | 91 | 6 | 3 | 76 | 1020 | 1241 | 0.060 | Absent | Absent | Present Example |
| 14 | J | 11.0 | 78 | 18 | 4 | 81 | 817 | 984 | 0.014 | Absent | Absent | Present Example |
| 15 | K | 9.0 | 66 | 34 | 0 | 87 | 638 | 874 | 0.018 | Absent | Present | Comparative Example |
| 16 | L | 27.3 | 86 | 0 | 14 | 57 | 643 | 824 | 0.195 | Absent | Absent | Comparative Example |
| 17 | M | 12.3 | 88 | 6 | 6 | 62 | 987 | 1203 | 0.054 | Absent | Absent | Comparative Example |
| 18 | N | 27.3 | 100 | 0 | 0 | 80 | 765 | 900 | 0.193 | Absent | Present | Comparative Example |
| 19 | O | 31.3 | 78 | 5 | 17 | 64 | 867 | 1032 | 0.024 | Absent | Absent | Comparative Example |
| 20 | P | 11.3 | 67 | 33 | 0 | 89 | 658 | 904 | 0.024 | Absent | Present | Comparative Example |
| 21 | Q | 28.7 | 88 | 10 | 2 | 89 | 740 | 1027 | 0.028 | Absent | Present | Comparative Example |
| 22 | R | 28.4 | 100 | 0 | 0 | 86 | 715 | 914 | 0.141 | Absent | Present | Comparative Example |
| 23 | S | 26.4 | 74 | 9 | 17 | 69 | 763 | 919 | 0.024 | Absent | Absent | Comparative Example |
| 24 | T | 11.5 | 92 | 6 | 2 | 78 | 976 | 1215 | 0.061 | Absent | Absent | Present Example |
| 25 | U | 11.6 | 99 | 0 | 1 | 70 | 941 | 1057 | 0.060 | Absent | Absent | Present Example |
| 26 | V | 9.3 | 99 | 0 | 1 | 71 | 945 | 1086 | 0.062 | Absent | Absent | Present Example |
| 27 | A | 10.2 | 99 | 0 | 1 | 73 | 1074 | 1210 | 0.065 | Absent | Absent | Present Example |
| 28 | A | 7.2 | 100 | 0 | 0 | 78 | 1078 | 1213 | 0.063 | Absent | Absent | Present Example |
| 29 | B | 8.8 | 100 | 0 | 0 | 77 | 1094 | 1212 | 0.070 | Absent | Absent | Present Example |
| 30 | B | 8.2 | 100 | 0 | 0 | 78 | 1072 | 1186 | 0.071 | Absent | Absent | Present Example |
| 31 | C | 12.7 | 100 | 0 | 0 | 77 | 1078 | 1164 | 0.076 | Absent | Absent | Present Example |
| 32 | D | 25.9 | 88 | 10 | 2 | 75 | 1081 | 1176 | 0.060 | Absent | Absent | Present Example |
| 33 | E | 10.6 | 83 | 14 | 3 | 84 | 1081 | 1119 | 0.025 | Absent | Absent | Present Example |
| 34 | F | 28.8 | 100 | 0 | 0 | 85 | 1083 | 1158 | 0.070 | Absent | Absent | Present Example |
| 35 | F | 42.6 | 100 | 0 | 0 | 85 | 1036 | 1178 | 0.060 | Absent | Present | Comparative Example |
| 36 | G | 12.6 | 100 | 0 | 0 | 80 | 1091 | 1142 | 0.070 | Absent | Absent | Present Example |
| 37 | H | 38.5 | 100 | 0 | 0 | 86 | 1075 | 1109 | 0.055 | Absent | Absent | Present Example |
| 38 | I | 27.0 | 93 | 6 | 1 | 72 | 1065 | 1174 | 0.057 | Absent | Absent | Present Example |
| 39 | I | 38.7 | 90 | 8 | 2 | 78 | 1073 | 1242 | 0.062 | Absent | Absent | Present Example |
| 40 | J | 11.7 | 84 | 14 | 2 | 81 | 1066 | 1106 | 0.016 | Absent | Absent | Present Example |
| 41 | K | 9.6 | 65 | 33 | 2 | 86 | 737 | 870 | 0.033 | Absent | Present | Comparative Example |
| 42 | L | 25.4 | 87 | 0 | 13 | 55 | 747 | 819 | 0.198 | Present | Absent | Comparative Example |
| 43 | M | 11.5 | 91 | 4 | 5 | 63 | 1088 | 1204 | 0.058 | Absent | Absent | Comparative Example |
| 44 | N | 28.3 | 100 | 0 | 0 | 78 | 862 | 896 | 0.189 | Present | Present | Comparative Example |
| 45 | P | 11.5 | 64 | 35 | 1 | 89 | 753 | 907 | 0.023 | Absent | Present | Comparative Example |
| 46 | Q | 27.6 | 86 | 11 | 3 | 91 | 837 | 1022 | 0.026 | Absent | Present | Comparative Example |
| 47 | R | 26.6 | 100 | 0 | 0 | 84 | 810 | 915 | 0.142 | Absent | Present | Comparative Example |
| 48 | A | 54.0 | 99 | 0 | 1 | 74 | 962 | 1213 | 0.053 | Absent | Present | Comparative Example |
| 49 | W | 10.2 | 100 | 0 | 0 | 73 | 1077 | 1215 | 0.060 | Absent | Absent | Present Example |

The present examples all had superior hot workability with a yield strength YS of 758 MPa or more. The corrosion resistance (carbon dioxide gas corrosion resistance) in a high-temperature corrosive environment of 180° C. or more containing $CO_2$ and $Cl^-$, and the low-temperature SSC resistance were also desirable in all of the present examples.

The values obtained in Comparative Examples that did not fall in the ranges according to aspects of the present invention were not desirable in at least one of yield strength YS, hot workability, carbon dioxide gas corrosion resistance, and low-temperature SSC resistance.

The invention claimed is:

1. A high-strength stainless steel seamless pipe for oil country tubular goods having a composition that comprises, in mass %, C: 0.002 to 0.05%, Si: 0.05 to 0.50%, Mn: 0.04 to 1.80%, P: 0.030% or less, S: 0.002% or less, Cr: more than 14.0% and 17.0% or less, Ni: 4.0 to 8.0%, Mo: 1.5 to 3.0%, Al: 0.005 to 0.10%, V: 0.005 to 0.20%, Co: 0.01 to 1.0%, N: 0.002 to 0.15%, and O: 0.006% or less, and that satisfies the following formulae (1) and (2), and in which the balance is Fe and incidental impurities, the high-strength stainless steel seamless pipe having a microstructure containing prior austenite having an average grain size of 40 μm or less, the high-strength stainless steel seamless pipe having a yield strength of 1034 MPa or more, $$Cr+0.65Ni+0.6Mo+0.55Cu-20C\geq 18.5 \quad (1)$$

$$Cr+Mo+0.3Si-43.3C-0.4Mn-Ni-0.3Cu-9N\leq 11 \quad (2),$$

wherein Cr, Ni, Mo, Cu, C, Si, Mn, and N represent the content of each element in mass %, and the content is zero for elements that are not contained.

2. The high-strength stainless steel seamless pipe for oil country tubular goods according to claim 1, wherein the composition further comprises, in mass %, one or two groups selected from the following group A and group B, Group A: one or two or more selected from Cu: 3.5% or less, Ti: 0.20% or less, and W: 3.0% or less, Group B: one or two or more selected from Nb: 0.20% or less, Zr: 0.20% or less, B: 0.01% or less, REM: 0.01% or less, Ca: 0.0025% or less, Sn: 0.20% or less, Sb: 0.50% or less, Ta: 0.1% or less, and Mg: 0.01% or less.

3. The high-strength stainless steel seamless pipe for oil country tubular goods according to claim 1, wherein the microstructure contains a martensitic phase having an area percentage of 70% or more.

4. The high-strength stainless steel seamless pipe for oil country tubular goods according to claim 2, wherein the microstructure contains a martensitic phase having an area percentage of 70% or more.

5. A method for manufacturing a high-strength stainless steel seamless pipe for oil country tubular goods of claim 1, the method comprising:

heating a steel pipe material of said composition in a heating temperature range of 1,100 to 1,350° C., and hot working the steel pipe material into a seamless steel pipe;

quenching in which the seamless steel pipe is reheated to at least an $Ac_3$ transformation point and not more than 1,050° C., and cooled to 100° C. or less at a cooling rate of air cooling or faster; and tempering in which the seamless steel pipe is heated to a tempering temperature of 500° C. or more and not more than an $Ac_1$ transformation point.

6. The method for manufacturing a high-strength stainless steel seamless pipe for oil country tubular goods according to claim 5, wherein the composition further comprises, in mass %, one or two groups selected from the following group A and group B, Group A: one or two or more selected from Cu: 3.5% or less, Ti: 0.20% or less, and W: 3.0% or less, Group B: one or two or more selected from Nb: 0.20% or less, Zr: 0.20% or less, B: 0.01% or less, REM: 0.01% or less, Ca: 0.0025% or less, Sn: 0.20% or less, Sb: 0.50% or less, Ta: 0.1% or less, and Mg: 0.01% or less.

7. The method for manufacturing a high-strength stainless steel seamless pipe for oil country tubular goods according to claim 5, wherein the microstructure contains a martensitic phase having an area percentage of 70% or more.

8. The method for manufacturing a high-strength stainless steel seamless pipe for oil country tubular goods according to claim 6, wherein the microstructure contains a martensitic phase having an area percentage of 70% or more.

9. The method for manufacturing a high-strength stainless steel seamless pipe for oil country tubular goods according to claim 5, wherein the quenching and the tempering are repeated at least twice.

10. The method for manufacturing a high-strength stainless steel seamless pipe for oil country tubular goods according to claim 6, wherein the quenching and the tempering are repeated at least twice.

11. The method for manufacturing a high-strength stainless steel seamless pipe for oil country tubular goods according to claim 7, wherein the quenching and the tempering are repeated at least twice.

12. The method for manufacturing a high-strength stainless steel seamless pipe for oil country tubular goods according to claim 8, wherein the quenching and the tempering are repeated at least twice.

* * * * *